US008985006B1

(12) United States Patent
Christensen et al.

(10) Patent No.: US 8,985,006 B1
(45) Date of Patent: Mar. 24, 2015

(54) TRIGGER ASSEMBLY

(71) Applicant: TDJ, Inc., Fayette, UT (US)

(72) Inventors: Jason Christensen, Gunnison, UT (US); Vance Bowler, Gunnision, UT (US)

(73) Assignee: TDJ, Inc., Fayette, UT (US)

( * ) Notice: Subject to any disclaimer, the term of this patent is extended or adjusted under 35 U.S.C. 154(b) by 0 days.

(21) Appl. No.: 14/020,141

(22) Filed: Sep. 6, 2013

(51) Int. Cl.
*F41A 19/06* (2006.01)
*F41A 17/82* (2006.01)

(52) U.S. Cl.
CPC ..... *F41A 17/82* (2013.01); *F41A 19/06* (2013.01)
USPC ..... 89/142

(58) Field of Classification Search
CPC ..... F41A 17/74; F41A 17/72; F41A 17/64; F41A 17/46; F41A 19/14; F41A 19/10; F41A 19/45
USPC ..... 42/70.08, 69.03, 69.01, 70.04, 70.01, 42/70.05, 70.06; 89/132, 142, 144, 148
See application file for complete search history.

(56) References Cited

U.S. PATENT DOCUMENTS

| | | | | |
|---|---|---|---|---|
| 1,100,054 | A * | 6/1914 | Castle | 42/70.08 |
| 1,317,988 | A * | 10/1919 | Pedersen | 42/21 |
| 1,470,029 | A * | 10/1923 | Pedersen | 42/16 |
| 2,565,018 | A * | 8/1951 | Browning | 42/70.08 |
| 3,402,498 | A * | 9/1968 | Freitag et al. | 42/41 |
| 3,750,531 | A | 8/1973 | Angell et al. | |
| 4,002,101 | A | 1/1977 | Tellie | |
| 4,358,986 | A | 11/1982 | Giorgio | |
| 4,569,144 | A | 2/1986 | Thurber | |
| 4,664,015 | A * | 5/1987 | Kennedy | 89/138 |
| 4,962,606 | A | 10/1990 | Pozzi | |
| 5,157,209 | A | 10/1992 | Dunn | |
| 5,501,134 | A | 3/1996 | Milazzo et al. | |
| 5,903,994 | A * | 5/1999 | Tange | 42/70.01 |
| 6,119,387 | A * | 9/2000 | Butters et al. | 42/70.08 |
| 6,205,990 | B1 | 3/2001 | Adkins | |
| 6,615,527 | B1 * | 9/2003 | Martin | 42/69.03 |
| 6,722,072 | B1 | 4/2004 | McCormick | |
| 7,162,824 | B1 | 1/2007 | McCormick | |
| 7,293,385 | B2 | 11/2007 | McCormick | |
| 7,600,338 | B2 | 10/2009 | Geissele | |
| 7,992,335 | B2 | 8/2011 | Gangl | |
| 8,047,119 | B2 * | 11/2011 | Hochstrate et al. | 89/142 |
| 8,250,799 | B2 | 8/2012 | Duperry et al. | |
| 8,276,502 | B1 | 10/2012 | Wright | |
| 2007/0180984 | A1 | 8/2007 | Huther | |
| 2011/0126441 | A1 | 6/2011 | Vukovic | |
| 2011/0289811 | A1 | 12/2011 | Gentilini et al. | |

FOREIGN PATENT DOCUMENTS

| | | |
|---|---|---|
| DE | 20 2011004556 | 7/2012 |

* cited by examiner

*Primary Examiner* — Samir Abdosh
*Assistant Examiner* — John D Cooper

(57) ABSTRACT

A trigger assembly for use with a firearm has a hook carried by and pivotal with a selector to engage an aft tab of a hammer in the safe position of the selector.

21 Claims, 6 Drawing Sheets

TRIGGER ASSEMBLY

BACKGROUND

1. Field of the Invention

The present invention relates generally to a trigger assembly for a firearm.

2. Related Art

The AR-15 is a popular rifle and includes a safety selector that engages a trigger to resist the trigger from being pulled when the selector is set on safe. The trigger, in turn, has an edge that engages an edge of a hammer. Pulling the trigger pivots the edge of the trigger out of engagement with the edge of the hammer, allowing a spring to pivot the hammer into contact with a firing pin. The engaging edges of the trigger and the hammer may inadvertently disengage upon impact, such as a rifle drop, allowing the rifle to misfire.

SUMMARY OF THE INVENTION

It has been recognized that it would be advantageous to develop an additional safety for the AR-15 type or style of firearm or rifle. In addition, it has been recognized that it would be advantageous to develop an additional safety for trigger assemblies of firearms. Furthermore, it has been recognized that it would be advantageous to develop a secondary safety in addition to a primary safety for trigger assemblies of firearms.

The invention provides a trigger assembly for use with a firearm. The trigger assembly has a hook carried by and pivotal with a selector to engage an aft tab of a hammer in the safe position of the selector.

In accordance with a more detailed aspect of the invention, the selector can engage both a trigger and the hammer in the safe position. A cam of the selector can engage a trigger and the hook of the selector can engage the tab of the hammer in the safe position. The selector can have a shank extending through a bore of the hook. The shank and the bore can be keyed to one another. The hook can be carried by a shank of the selector. The hook can have a forked collar with the bore extending through the collar, and a slot extending into the collar transverse to the bore and exposing the shank of the selector, and thus a cam of the selector.

In addition, the invention provides a trigger assembly for use with a firearm and having a hammer configured to be pivotally coupled to the firearm and positioned to selectively strike a firing pin in a bolt mechanism of the firearm. The hammer has an aft tab. A trigger is pivotally coupled to the firearm and releasably engages the hammer to selectively engage and hold the hammer, and to selectively release the hammer to strike the firing pin when pulled by a user. A selector is pivotally coupled to the firearm and releasably engages the trigger to selectively engage and hold the trigger from being pivoted, and to release the trigger to be pulled by the user. The selector has at least a safe position to hold the trigger, and a fire position to allow the trigger to be pulled. A hook is fixedly mounted to the selector and pivotal therewith between the safe and fire positions. The hook engages the tab of the hammer in the safe position.

Furthermore, the invention provides a trigger assembly in combination with a firearm. The trigger assembly has a hammer pivotally coupled to the firearm and positioned to selectively strike a firing pin in a bolt mechanism of the firearm. The hammer has a hammer pivot, a tab aft of the pivot, and a lower edge beneath the pivot. A trigger is pivotally coupled to the firearm and releasably engaging the hammer to selectively engage and hold the hammer, and to selectively release the hammer to strike the firing pin when pulled by a user. The trigger has a trigger pivot, a fore edge forward of the trigger pivot and selectively engaging the lower edge of the hammer, and an aft arm. A selector is pivotally coupled to the firearm and releasably engages the trigger to selectively engage and hold the trigger from being pivoted, and to release the trigger to be pulled by the user. The selector has at least a safe position to hold the trigger, and a fire position to allow the trigger to be pulled. The selector has a shank disposed over the aft arm of the trigger with a cross-sectional shape with a lobe abutting to the aft arm of the trigger in the safe position, and a notch aligned with the aft arm of the trigger in the fire position. A hook is fixedly mounted to the selector and pivotal therewith between the safe and fire positions. The hook engages the tab of the hammer in the safe position.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Figure 1:
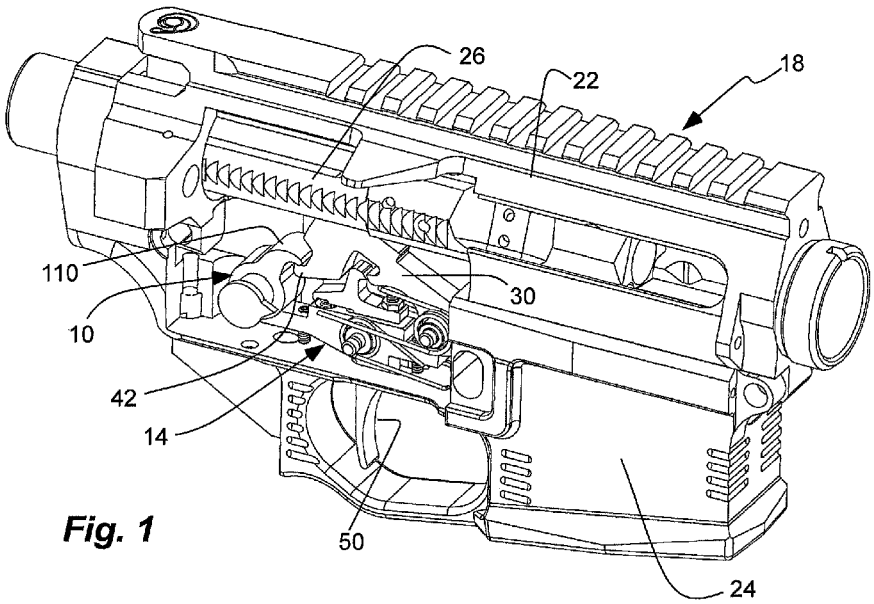
FIG. 1 is a perspective view of a trigger assembly in accordance with an embodiment of the present invention shown in a lower receiver of a firearm with a portion of the lower receiver removed for visibility.
Figure 2:
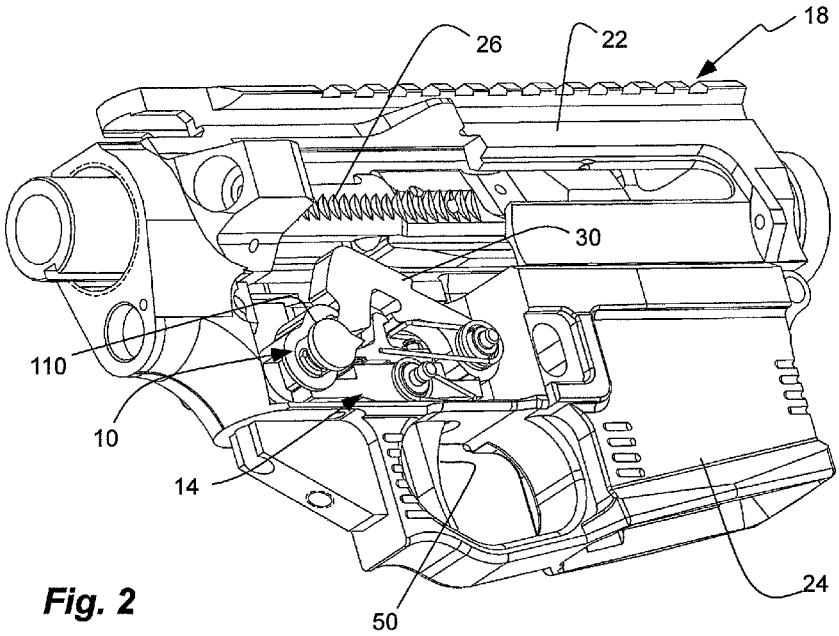
FIG. 2 is a perspective view of the trigger assembly of FIG. 1 again shown in the lower receiver of the firearm with the portion of the lower receiver removed for visibility.
Figure 3:
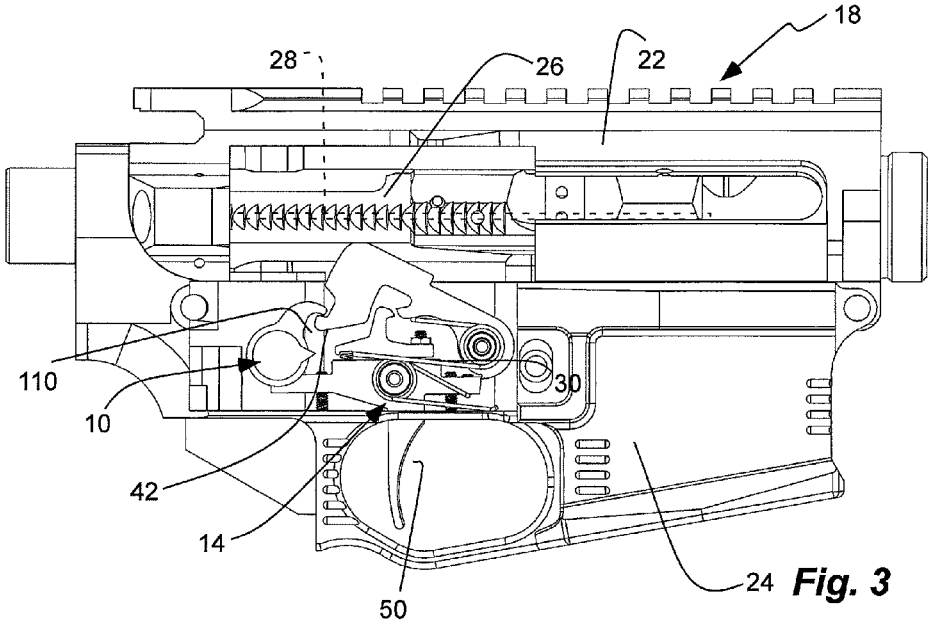
FIG. 3 is a right side view of the trigger assembly of FIG. 1 again shown in the lower receiver of the firearm with the portion of the lower receiver removed for visibility.
Figure 4:
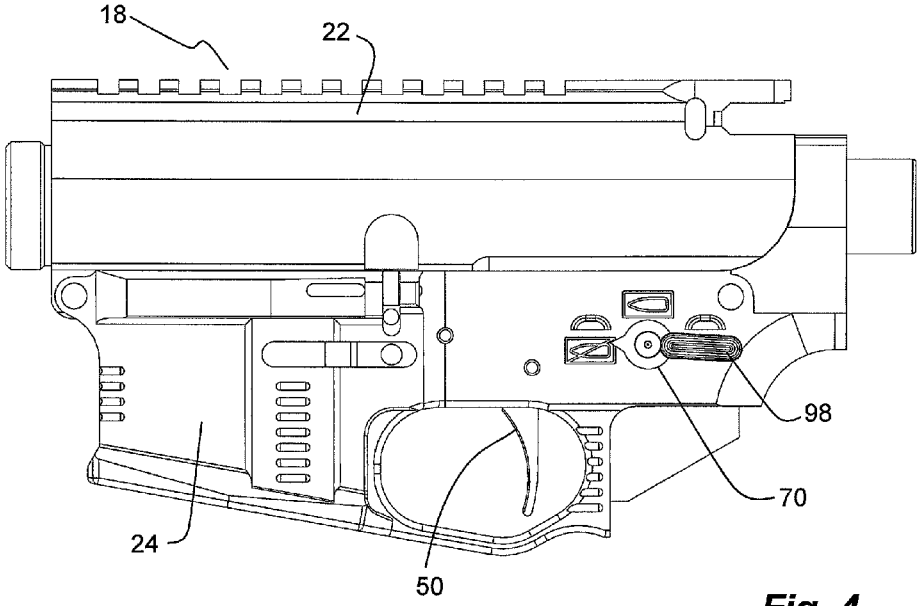
FIG. 4 is a left side view of a portion of the firearm, namely the upper and lower receivers, with the trigger assembly of FIG. 1 disposed therein, and showing a safety selector lever in a safe position.
Figure 5:
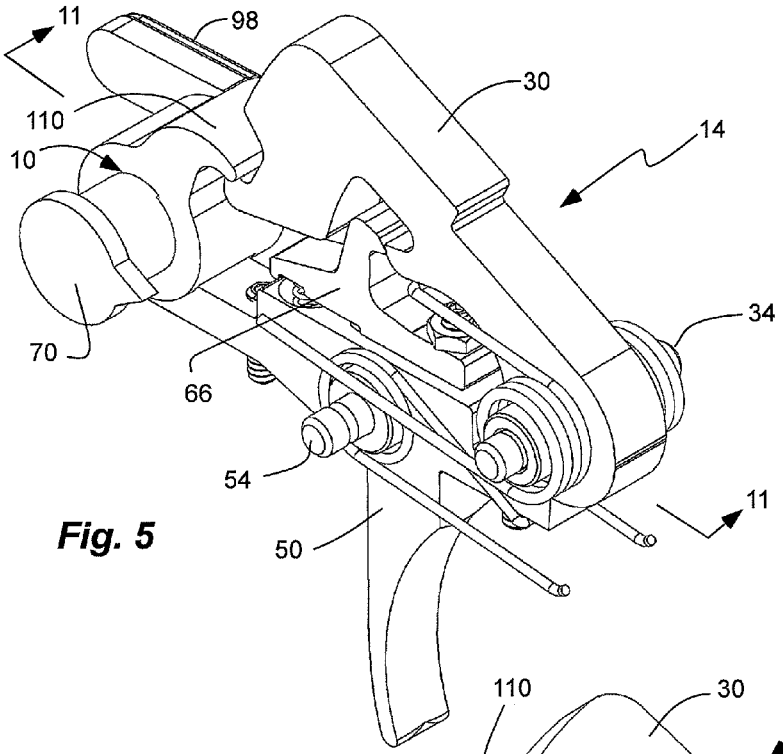
FIG. 5 is a perspective view of the trigger assembly of FIG. 1 shown in the safe position and the cocked position.
Figure 6:
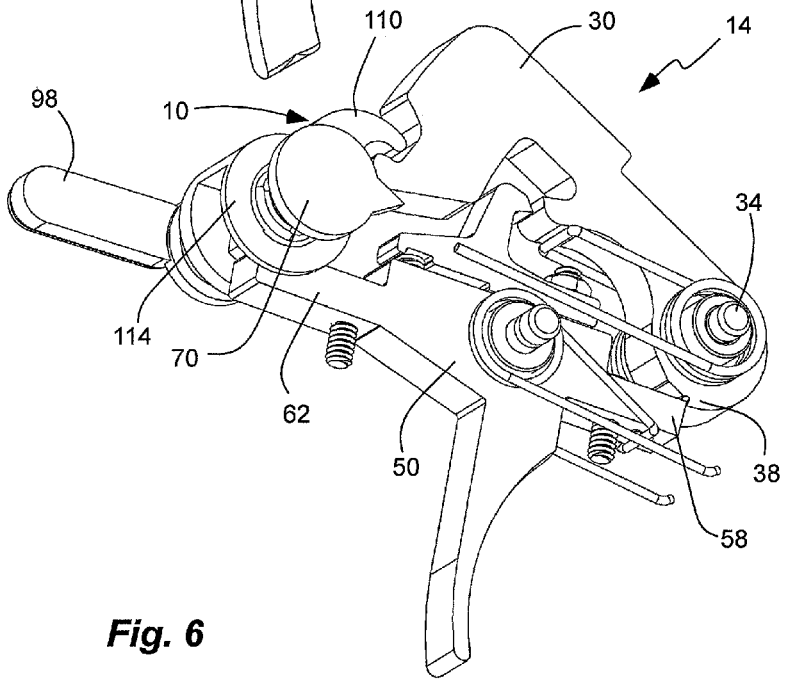
FIG. 6 is a perspective view of the trigger assembly of FIG. 1 shown in the safe position.
Figure 7:
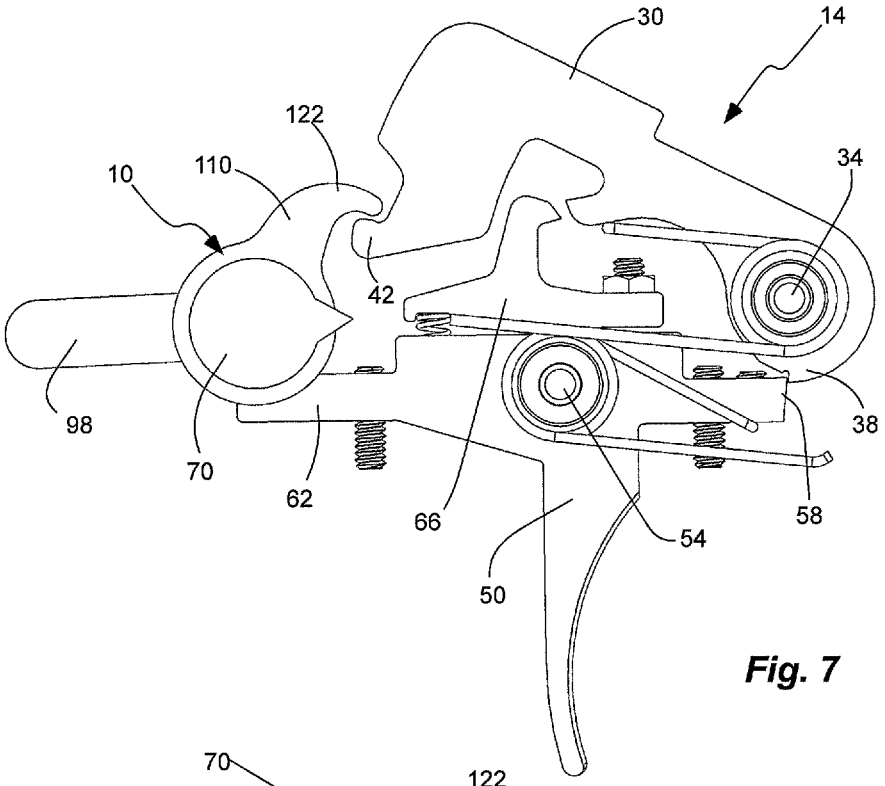
FIG. 7 is a side view of the trigger assembly of FIG. 1 shown in the safe position.
Figure 8:
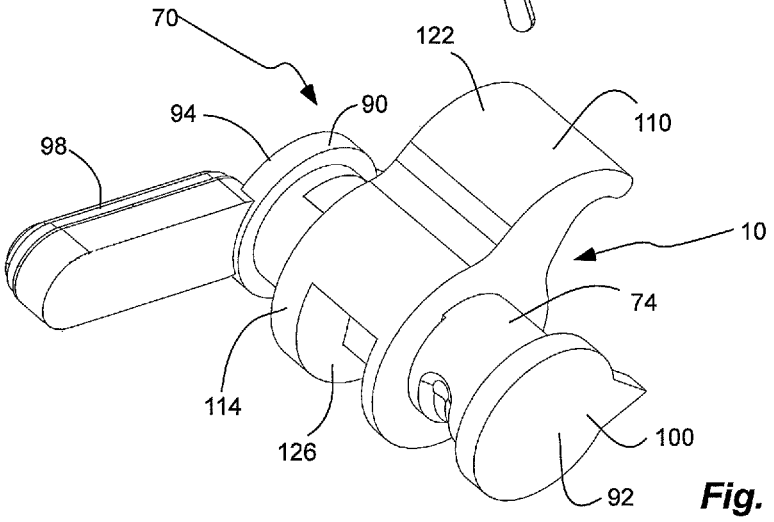
FIG. 8 is a perspective view of a hook and the safety selector lever of the trigger assembly of FIG. 1.
Figure 9:
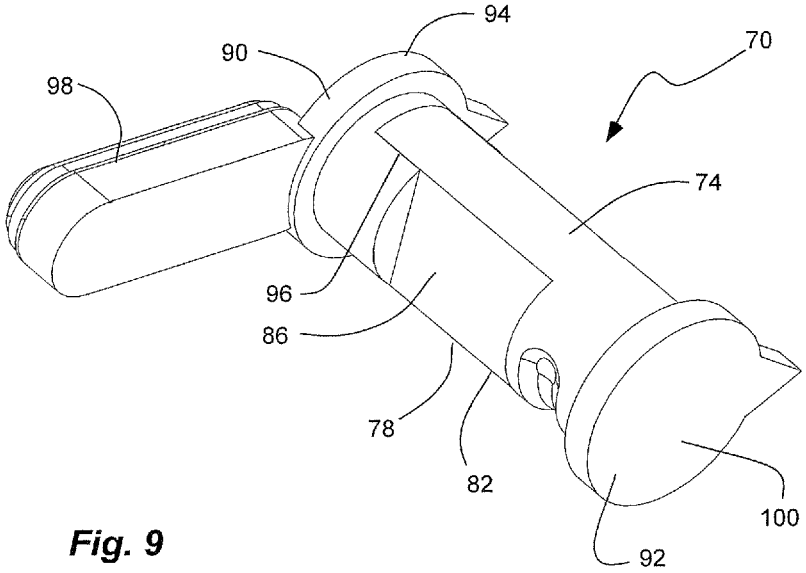
FIG. 9 is a perspective view of the safety selector lever of the trigger assembly of FIG. 1.
Figure 10:
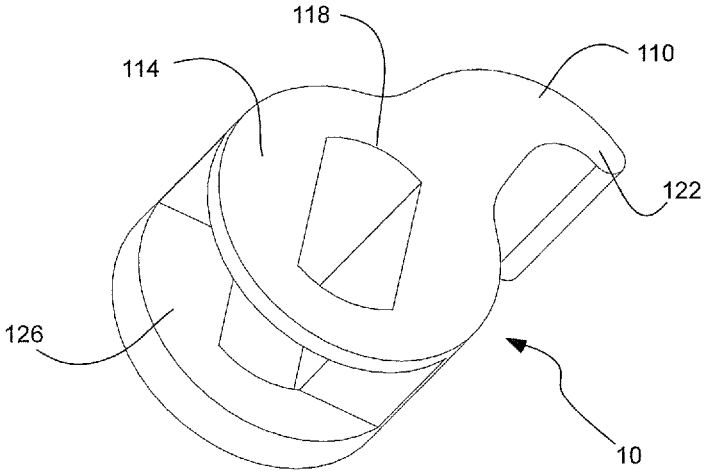
FIG. 10 is a perspective view of the hook of the trigger assembly of FIG. 1.

The trigger assembly shown in the drawings is configured for an AR-15 type or style of rifle, and the firearm shown in the drawings is an AR-15 type or style of rifle. In the drawings, only the upper and lower receiver of the rifle are shown, with a barrel removed from the upper receiver, and with a buttstock and a receiver extension or tube and associated spring and buffer assembly removed from the lower receiver.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

As illustrated in FIGS. 1-12, a safety or secondary safety or hammer safety, indicated generally at 10, in an example implementation in accordance with the invention is shown for a trigger assembly 14 of a firearm 18. The safety 10 can provide a positive and physical engagement with a hammer as a secondary safety, while a primary safety engages a trigger. Thus, the safety 10 provides an additional safety feature to the firearm 18 and resists inadvertent firing, such as might occur with a rifle drop.

The firearm 18 is shown and described as an AR-15 type or style of rifle. The firearm 18 can thus have upper and lower receivers 22 and 24 coupled together. The upper receiver 22 can carry the bolt or bolt carrier 26 and associated components, including a firing pin 28. (For clarity, the upper receiver is shown with various components removed, including the barrel, charging handle, etc. In addition, a portion of the upper receiver has been removed to view the bolt carrier. Thus, various components are not visible, including the ejection port and cover, forward assist plunger, etc.) The lower receiver 24 can carry the trigger assembly 14. (For clarity, the lower receiver is shown with various components removed, including the buttstock, receiver extension or tube, buffer assembly, pistol grip, etc. In addition, a portion of the lower receiver has been removed to view the trigger assembly.) The firearm 18 is shown and described as an AR-15 type or style of rifle by way of example. It will be understood by those of skill in the art, that the safety 10 of the present invention can be used with other types and styles of trigger assemblies and firearms.

The trigger assembly 10 is shown and described as an AR-15 type or style of trigger assembly. In addition, the trigger assembly 10 is shown and described as a semi-automatic type or style of trigger assembly. It will be understood by those of skill in the art that the trigger assembly can be configured for other types and styles of firearms, or for use with automatic firearms, such as an M16 type or style of rifle. The trigger assembly 10 includes a hammer 30 pivotally coupled to the firearm (e.g. the lower receiver 24) and positioned to selectively strike the firing pin in the bolt mechanism or carrier of the firearm. The hammer 30 can have a hammer pivot 34 (about a hammer retaining pin). A hammer spring can bias the hammer to pivot forwardly or towards the firing pin. The hammer can have an edge, such as a lower edge 38 beneath the pivot (in the cocked position of the hammer), to be used by the trigger to hold the hammer against the spring in the cocked position. The hammer can extend rearward from the pivot in the cocked position, and can have an aft tab 42 aft of the pivot (in the cocked position). Thus, the aft tab 42 can be distal with respect to the pivot.

The trigger assembly 10 includes a trigger 50 pivotally coupled to the firearm and releasably engaging the hammer 30 to selectively engage and hold the hammer, and to selectively release the hammer to strike the firing pin when pulled by a user. The trigger 50 can have a trigger pivot 54 (about a trigger pin). A trigger spring can bias the trigger to hold the hammer. The trigger 50 can have a fore edge 58 forward of the trigger pivot and selectively engaging the lower edge 38 of the hammer 30. Thus, the edges 38 and 58 of the hammer 30 and the trigger 50, respectively, engage to hold the hammer in the cocked position, as shown, and selectively disengage to allow hammer fall, or the spring to pull the hammer into contact with the firing pin. In addition, the trigger 50 can have an aft arm 62 aft or rear of the pivot to form a part of the safety, as discussed below.

The trigger assembly can also include a disconnector 66 with a hook engaging an intermediate hook at an intermediate location on the hammer. The disconnector catches and holds the hammer after firing (and after the bolt carrier has returned the hammer) and while the trigger is still being held, to prevent the hammer from returning to the firing position under the influence of the spring while the trigger is still pulled. After the trigger is released, the disconnecter releases hammer so that it is ready to fire again.

The trigger assembly includes a selector 70 pivotally coupled to the firearm (such as the lower receiver) and releasably engaging the trigger 50 to selectively engage and hold the trigger from being pivoted, and to release the trigger to be pulled by the user. The selector has at least a safe position (FIGS. 7 and 11) to hold the trigger, and a fire position (FIG. 12) to allow the trigger to be pulled. The selector 70 can have a shank 74 or pin disposed over the aft arm 62 of the trigger 50 with a cross-sectional shape or cam 78, such as a lobe 82 abutting to the aft arm 62 of the trigger in the safe position, and a notch 86 aligned with the aft arm of the trigger in the fire position.

The selector 70 can have two halves affixed together, including a first engagement side 90 and a second side 92. The first engagement side 90 can have an enlarged head 94 disposed on one side of the shank 74 and outside the firearm (or lower receiver), a slot 96 in the head receiving the shank therein. The first engagement side 90 can also have a selector arm 98 disposed outside the firearm (or lower receiver) and attached to the enlarged head and engageable by a user to pivot the selector. The head 94 can have an indicator pointing to indicia on the firearm or lower receiver to indicate the position of the selector (such as on safe or fire). The second side 92 can have the shank 74 and an enlarged head 100 disposed on the opposite side of the shank from the head 94 of the first engagement side 90. The heads 94 and 100 are disposed outside the firearm (or lower receiver) while the shank 74 or pin extends through the firearm (or lower receiver) and forms a pivot for the selector.

The shank 74 can have a cross-sectional shape that is oblong forming a cam 78 with a long side forming a lobe 82 configured to abut to the aft arm 62 of the trigger 50 in the safe position, and a short side forming a notch 86 configured to align with the aft arm of the trigger in the fire position. The cam or oblong cross-sectional shape can be formed by forming the notch 86 in the circular or round cross-sectional shape of the shank 74.

Figure 11:
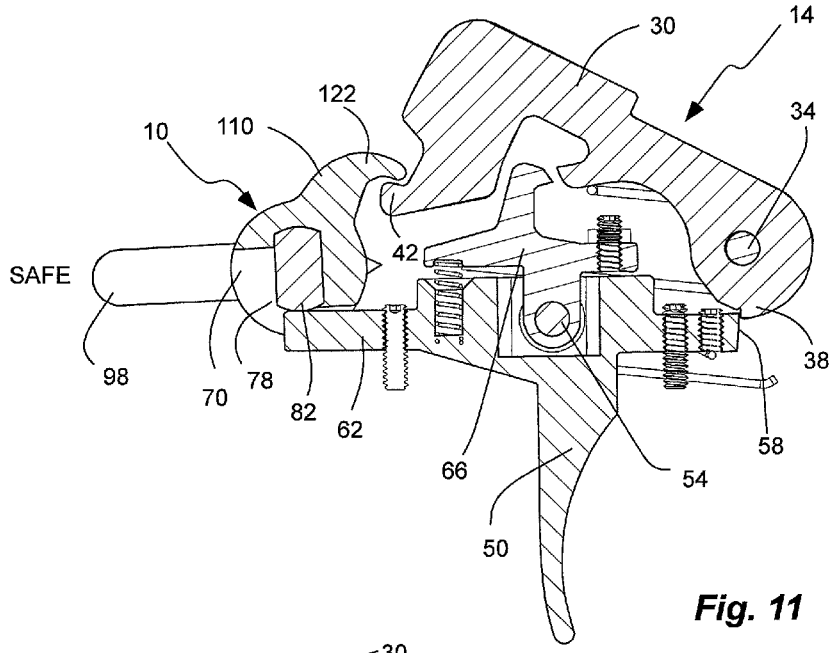
FIG. 11 is a cross-sectional side view of the trigger assembly of FIG. 1, taken along line 11 of FIG. 5, shown in the safe position.
Figure 12:
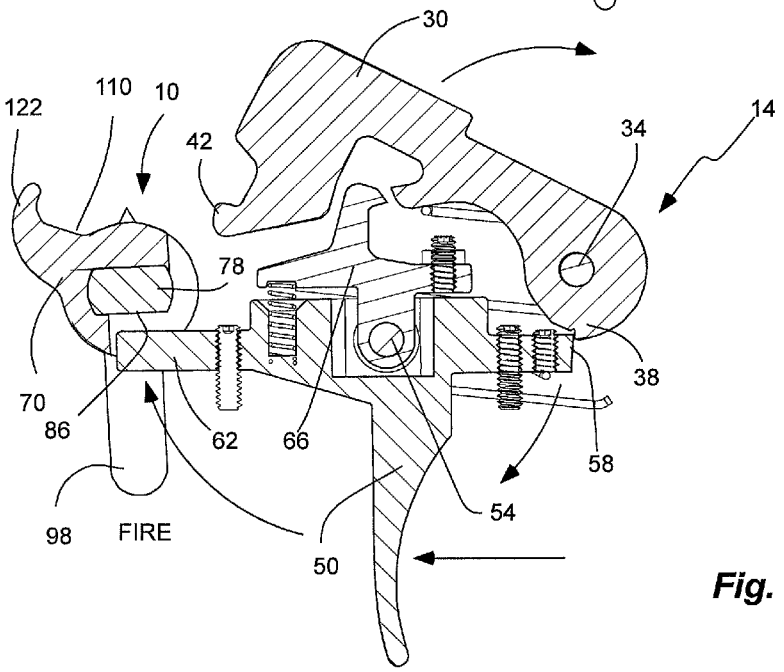
FIG. 12 is a cross-sectional side view of the trigger assembly of FIG. 1, shown in a fire position.

The safety 10, the trigger assembly 14 and the selector 70 have a hook 110 fixedly mounted to the selector or shank, and pivotal therewith between the safe and fire positions. The hook 110 engages the tab 42 of the hammer 30 in the safe position, as shown in FIG. 11. Thus, the selector 70 engages both the trigger 50 and the hammer 30 in the safe position by the cam 78 and the hook 110, respectively. The cam 78 of the selector 70 engages the trigger 50, or aft arm 62 thereof, and the hook 110 of the selector engages the tab 42 of the hammer 30 in the safe position. The hook 110 can include a collar 114 with a bore 118 therein to receive the shank 74 of the selector, and a hook projection 122 extending from the collar to engage the tab of the hammer. The hook or hook projection can extend forwardly when the selector is in the safe position. A transverse slot 126 can be formed in the collar 114 perpendicular to an axis of the bore 118 and the pivot axis of the selector, forming a forked collar. The shank of the selector can extend through the bore of the hook, and the hook can be carried by a shank of the selector. The slot can extend into the bore 118 and can expose two adjacent sides of the bore, and thus can expose the lobe 82 and the notch 86 of the selector, or shank or cam thereof. Thus, the hook 110 has a forked collar 114 with the bore 118 extending through the collar, and a slot 126 extending into the collar transverse to the bore and exposing the shank of the selector, and thus a cam of the selector. The bore 118 of the hook 110 can have a cross-sectional shape matching or mating with the shank. Thus, the shank and the bore are keyed to one another. As discussed above, the shank can have two-halves that can be affixed together to retain the hook therebetween.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A trigger assembly device configured for use with a firearm, the device comprising:

a) a hammer configured to be pivotally coupled to the firearm and positioned to selectively strike a firing pin in a bolt mechanism of the firearm, the hammer having an aft tab;

b) a trigger configured to be pivotally coupled to the firearm and releasably engaging the hammer to selectively engage and hold the hammer, and to selectively release the hammer to strike the firing pin when pulled by a user;

c) a selector configured to be pivotally coupled to the firearm and releasably engaging the trigger to selectively engage and hold the trigger from being pivoted, and to release the trigger to be pulled by the user, the selector having at least a safe position to hold the trigger, and a fire position to allow the trigger to be pulled; and d) a hook fixedly mounted to the selector and pivotal therewith between the safe and fire positions, and engaging the tab of the hammer in the safe position.

2. A device in accordance with claim 1, wherein the selector engages both the trigger and the hammer in the safe position.

3. A device in accordance with claim 1, wherein a cam of the selector engages the trigger and the hook of the selector engages the tab of the hammer in the safe position.

4. A device in accordance with claim 1, wherein the selector has a shank extending through a bore of the hook; and wherein the shank and the bore are keyed to one another.

5. A device in accordance with claim 1, wherein the hook is carried by a shank of the selector.

6. A device in accordance with claim 1, wherein the hook has a forked collar with the bore extending through the collar and a slot extending into the collar transverse to the bore and exposing the shank of the selector, and thus a cam of the selector.

7. A device in accordance with claim 1, wherein the selector further comprises two halves affixed together and retaining the hook therebetween, the two halves of the selector comprising:

a first engagement side with an enlarged head disposed on one side of a shank, a slot in the head receiving the shank therein, and a selector arm attached to the enlarged head and engageable by a user to pivot the selector; and a second side having the shank and an enlarged head disposed on the opposite side of the shank from the head of the first engagement side; and the shank having an oblong cross-sectional shape with a long side forming a lobe configured to abut to an aft arm of the trigger in the safe position, and a short side forming a notch configured to align with the aft arm of the trigger in the fire position.

8. A device in accordance with claim 7, wherein the hook further comprises:

a collar surrounding the bore;

a hook projection extending from the collar to engage the tab of the hammer;

a transverse slot formed in the collar perpendicular to an axis of the bore and the pivot axis of the selector, and extending into the bore and exposing two adjacent sides of the bore, and thus exposing the lobe and the notch of the selector.

9. A device in accordance with claim 1, wherein the tab of the hammer extends rearwardly from a top or a back of the hammer when the hammer is in a cocked position; and wherein a hook portion of the hook extends forwardly when the selector is in the safe position.

10. A trigger assembly device in combination with a firearm, the device comprising:

a) a hammer pivotally coupled to the firearm and positioned to selectively strike a firing pin in a bolt mechanism of the firearm, the hammer having a hammer pivot, a tab aft of the pivot, and a lower edge beneath the pivot;

b) a trigger pivotally coupled to the firearm and releasably engaging the hammer to selectively engage and hold the hammer, and to selectively release the hammer to strike the firing pin when pulled by a user, the trigger having a trigger pivot, a fore edge forward of the trigger pivot and selectively engaging the lower edge of the hammer, and an aft arm;

c) a selector pivotally coupled to the firearm and releasably engaging the trigger to selectively engage and hold the trigger from being pivoted, and to release the trigger to be pulled by the user, the selector having at least a safe position to hold the trigger, and a fire position to allow the trigger to be pulled, the selector having a shank disposed over the aft arm of the trigger with a cross-sectional shape with a lobe abutting to the aft arm of the trigger in the safe position, and a notch aligned with the aft arm of the trigger in the fire position; and d) a hook fixedly mounted to the selector and pivotal with the selector between the safe and fire positions, and the hook engaging the tab of the hammer in the safe position.

11. The combination in accordance with claim 10, wherein the hook has a bore receiving the shank of the selector therethrough and with a cross-sectional shape keyed with the cross-sectional shape of the shank of the selector.

12. The combination in accordance with claim 10, wherein the selector further comprises two halves affixed together and retaining the hook therebetween, the two halves of the selector comprising:

a first engagement side with an enlarged head disposed on one side of the shank, a slot receiving the shank therein, and a selector arm attached to the enlarged head and engageable by a user to pivot the selector; and a second side having the shank and an enlarged head disposed on the opposite side of the shank from the head of the first engagement side; and the shank having an oblong cross-sectional shape with a long side forming the lobe abutting to the aft arm of the trigger in the safe position, and a short side forming the notch aligned with the art arm of the trigger in the fire position.

13. The combination in accordance with claim 12, wherein the hook further comprises:

a collar surrounding a bore;

a hook projection extending from the collar to engage the tab of the hammer;

a transverse slot formed in the collar perpendicular to an axis of the bore and the pivot axis of the selector, and extending into the bore and exposing two adjacent sides of the bore, and thus exposing the lobe and the notch of the selector.

14. The combination in accordance with claim 10, wherein the tab of the hammer extends rearwardly from a top or a back of the hammer when the hammer is in a cocked position; and wherein a hook portion of the hook extends forwardly when the selector is in the safe position.

15. A trigger assembly device configured for use with a firearm, the device comprising:

a hook fixedly mounted to and pivotal with a selector to engage an aft tab of a hammer in a safe position of the selector; and wherein a cam of the selector engages a trigger and the hook of the selector engages the tab of the hammer in the safe position so that the selector engages both the trigger and the hammer in the safe position.

16. A device in accordance with claim 15, wherein the selector has a shank extending through a bore of the hook; and wherein the shank and the bore are keyed to one another.

17. A device in accordance with claim 15, wherein the hook is carried by a shank of the selector.

18. A device in accordance with claim 15, wherein the hook has a forked collar with the bore extending through the collar and a slot extending into the collar transverse to the bore and exposing the shank of the selector, and thus a cam of the selector.

19. A device in accordance with claim 15, further comprising:

the selector having at least the safe position configured to hold the trigger, and a fire position configured to allow the trigger to be pulled; and the selector having a shank configured to be disposed over an aft arm of the trigger with a cross-sectional shape with a lobe configured to abut to the aft arm of the trigger in the safe position, and a notch configured to align with the aft arm of the trigger in the fire position.

20. A device in accordance with claim 15, further comprising:

the selector has a shank extending through a bore of the hook; and the shank and the bore are keyed to one another.

21. A device in accordance with claim 15, wherein the hook further comprises:

a collar surrounding a bore;

the selector has a shank extending through a bore of the hook;

a hook projection extending from the collar configured to engage the aft tab of the hammer; and a transverse slot formed in the collar perpendicular to an axis of the bore and the pivot axis of the selector, and extending into the bore and exposing two adjacent sides of the bore, and thus exposing a lobe and a notch of the selector.

* * * * *